United States Patent [19]

Wickstrom

[11] 3,937,229

[45] Feb. 10, 1976

[54] METHOD FOR EXTINGUISHING CIGARETTES AND APPARATUS

[76] Inventor: Carl Ervine Wickstrom, P.O. Box 83, Emigrant Gap, Calif. 95715

[22] Filed: Mar. 15, 1974

[21] Appl. No.: 451,582

Related U.S. Application Data

[63] Continuation-in-part of Ser. No. 348,849, April 6, 1973, abandoned.

[52] U.S. Cl. ..... 131/256; 131/237

[51] Int. Cl.[2] ..... A24F 13/18

[58] Field of Search ..... 131/235 R, 235 ST, 237, 131/240 E, 256

[56] References Cited

UNITED STATES PATENTS

| | | | |
|---|---|---|---|
| 1,848,388 | 3/1932 | Seitz | 131/237 |
| 2,561,124 | 7/1951 | Lacker | 131/240 E |
| 2,639,718 | 5/1953 | Leong | 131/256 |
| 2,644,466 | 7/1953 | Jennings | 131/237 X |
| 2,644,468 | 7/1953 | Kenes | 131/240 E X |
| 3,111,128 | 11/1963 | Yard, Jr. | 131/256 |
| 3,225,775 | 12/1965 | Nyc | 131/256 |
| 3,698,401 | 10/1972 | Tucker | 131/235 R |

*Primary Examiner*—Louis G. Mancene
*Assistant Examiner*—John F. Pitrelli
*Attorney, Agent, or Firm*—Herbert C. Schulze

[57] ABSTRACT

The heat of a burning cigarette is used to contain and hold a cigarette in an extinguishing holder. Thereafter, the lack of heat triggers release of the cigarette and removal of the cigarette from the holder. The device uses a bi-metallic element against which the cigarette is placed and which holds the cigarette in position so that it heats up. When the cigarette is extinguished and cools a bi-metallic element, which is connected to a latching mechanism affects the operation of a trap door permitting the cigarette to drop from the holder. A counter weight returns the trap door of the holder to its original position.

10 Claims, 8 Drawing Figures

METHOD FOR EXTINGUISHING CIGARETTES AND APPARATUS

CROSS REFERENCE TO RELATED PATENT APPLICATIONS

This patent application is related to, and a continuation in part of my co-pending patent application Ser. No. 348,849, filed Apr. 6, 1973, now abandoned.

BACKGROUND OF THE INVENTION

1. Field of the Invention

This invention is in the general field of receptacles for receiving lighted cigarettes, and more particularly in the field of a receptacle for receiving lighted cigarettes and extinguishing the same.

2. Description of the Prior Art

There have been numerous developments in the field of ashtrays and other receptacles to receive burning cigarettes. In some cases there have been efforts to provide such receptacles with means to extinguish cigarettes. Such mediums as sand, water and the like have been attempted for this purpose.

None of the prior art, including those utilizing a bi-metallic element to react to the generation of heat, are in the field of my invention, which is based upon holding a cigarette, extinguishing the same, and expelling it when, and only when, the heat (in other words the burning) has ceased, at which time it is safe to expel the cigarette.

SUMMARY OF THE INVENTION

The dropping of lighted cigarettes from an ash tray has been quite common and has led in the past to many incidents of both property damage and death. An unattended lighted cigarette left to burn for a period of time has been the causative factor in such incidents.

This invention makes it possible to place a burning cirgarette in a safe position, in which after a period of time it is extinguished, and then dropped into a tray.

The lack of heat is used to drop the cigarette, after it has been extinguished, contrary to the practice used in a number of prior art devices.

A particularly configured bi-metallic element against which the cigarette is placed, and to the end of which a latch operating mechanism is connected, is used to bring about this novel result.

A trap door having a counterweight and against which the cigarette leans, permits the extinguished cigarette to drop from the receptacle after it has been extinguished.

Accordingly, it is an object of this invention to provide a method and means for holding a lighted cigarette in an extinguishing device, until the cigarette is extinguished, sensing the extinguishing of the cigarette, and expelling the cigarette as a function of the sensing of the extinguishment thereof.

It is a further object of this invention to accomplish the foregoing object in which a bi-metallic strip is utilized to exert necessary pressure to hold a lighted cigarette until it has been extinguished and then to dispose of it.

It is a further object of this invention to provide a method and apparatus as aforedescribed which can be safely and conveniently used by the operators of equipment without diverting attention from their equipment.

Another object of this invention is to provide such a device as has been described wherein it may be fastened by magnetic forces to magnetically attractive materials.

The foregoing and other objects and advantages will be clear to those skilled in the art upon reading the following Description of a Preferred Embodiment in conjunction with the appended drawings.

DESCRIPTION OF A PREFERRED EMBODIMENT

Figure 6:
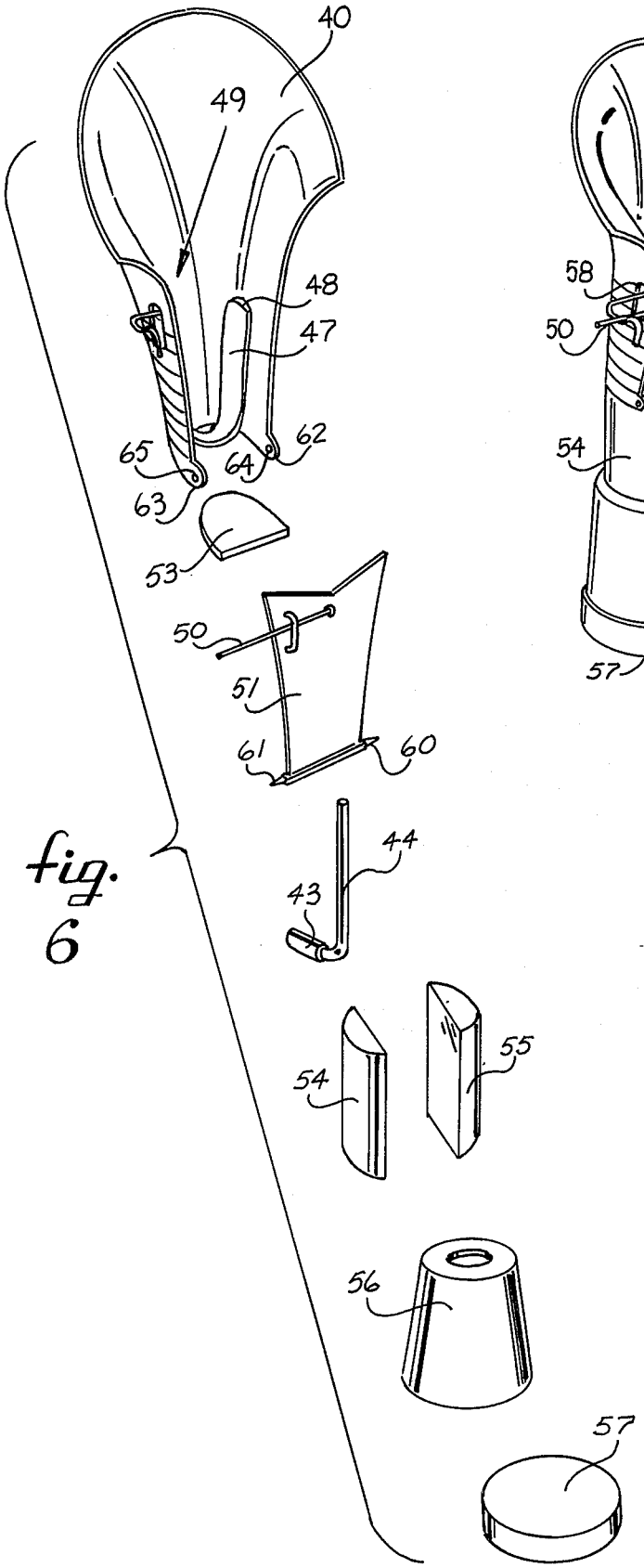
FIG. 6 is an exploded view of the elements making up the device of FIG. 4.
Figure 4:
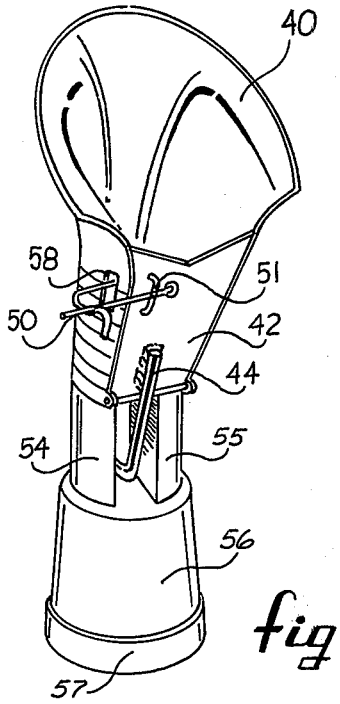
FIG. 4 is a perspective of the device of FIGS. 1, 2, and 3 in slightly different scale and attached to a mounting base.
Figure 5:
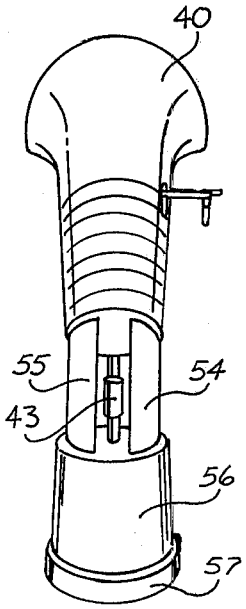
FIG. 5 is a rear elevation of the device as shown in FIG. 4.

FIGS. 1, 2, 3, 7 and 8 illustrate the operating features of an apparatus to practice the method of this invention. FIGS. 4, 5, and 6 show in more detail a preferred construction of a complete device suitable to practice the method of this invention.

The construction of the device to practice this method is best understood by examination of FIGS. 4, 5, and 6. Attention will first be given to this in order that the structure and operational elements will first be capable of construction.

There is a basic holder 40 for a cigarette, which preferably will be more or less the shape illustrated in order to provide a wide funnel-like opening for ease of depositing the cigarette therein and tapering towards the bottom so as to closely approximate the size of a cigarette. The bottom closure 53 may be formed integrally with the receptacle, or, as illustrated, may be a separate item which may be attached by appropriate adhesive or the like to the lower portion of the receptacle 40.

A pair of tabs 62 and 63 are provided at the lower extremity of the holder 40 and these tabs have holes 64 and 65 suitable to accept pins 60 and 61 on door element 42 in order to provide a hinge-like arrangement.

The door 42 covers the open side of the device in a manner as illustrated.

The door 42 has attached thereto a rod or the like 44 by means of suitable adhesive at 45. The rod 44 carries a weight 43 which serves the purpose of a counter weight.

On the interior of receptacle 40 a bi-metallic strip 47 is attached by suitable adhesive or the like at 48 in such manner than upon the application of heat to the bi-metallic strip 47 the unattached end which carries hook 46 on rod 52 will move upward, and upon the cessation of such heat it will again move downward. The rod 52 carrying the hook 46 is attached to the end of the bi-metallic strip by suitable adhesive or the like at 49. The rod 52 carrying the hook 46 will be seen to extend from its connection with bi-metallic strip 47 through slot 58 in the side of the receptacle 40.

The door element 42 carries a pivotably mounted rod 50 as indicated so as to be pivotally movable within the guide 51, which is formed of wire or the like and secured to the door 42 as indicated. This guide confines the movement of the rod 50 within small limitations, as can be observed.

A preferred base arrangement comprises a pair of upright members 54 and 55 secured to the bottom of the bottom piece 53 of the receptacle by suitable adhesive or the like, and secured to a stable base member 56 also by suitable adhesive. When assembled, the members 54 and 55 will be spaced from one another as shown in FIGS. 4 and 5 in such manner as to allow the weight 43 to swing freely between them.

A magentic disc 57 or the like will preferably be secured to the bottom of the stable base 56 by adhesive or the like in order that it may be placed upon a magnetically attractable surface and be held firmly in position. This is a particularly desirable feature for use in connection with automobiles and the like wherein the device may be desired to be used within an automobile and will be secure against jarring loose by magnetic attraction to an appropriate element of the vehicle, and will easily be mounted in numerous positions.

Figure 1:
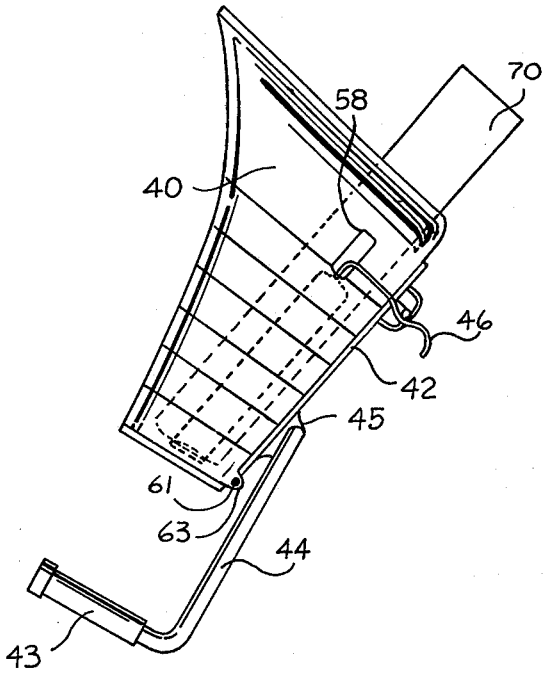
FIG. 1 is a side elevation of a preferred embodiment of an apparatus to practice the method of this invention with certain elements shown in phantom, and with a cigarette in place therein.
Figure 2:
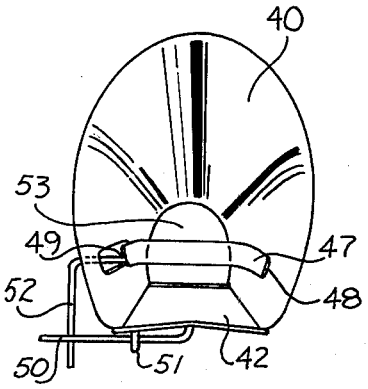
FIG. 2 is a top elevation of the embodiment shown in FIG. 1, but without a cigarette in place.

Now turning particular attention to FIGS. 1, 2, 3, 7, and 8, the operation of the device will be clearly understood. In FIG. 1, a lighted cigarette 70 has been placed in the device.

Figure 7:
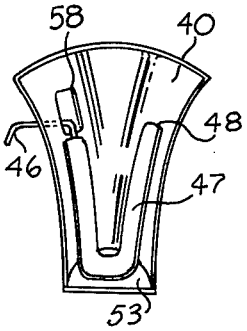
FIG. 7 is a front elevation of the embodiment shown in FIGS. 1, 2, and 3, with the front door removed, and in different scale, and illustrating one position of a bi-metallic strip which is utilized in the apparatus.
Figure 8:
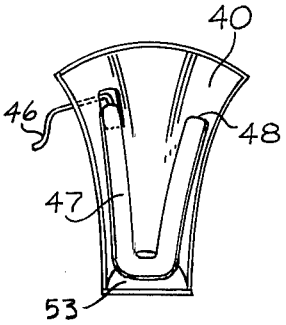
FIG. 8 is the same view as FIG. 7 showing the bi-metallic strip in a different operative position.

It is noted that the door is held in a closed position by the action of the hook-like arrangement 46 against the rod 50. When the cigarette is cool, the bi-metallic strip 47 will have the position as shown in FIG. 7, wherein the hook is held in a lowered position. Under the influence of the heat of the burning end of the cigarette which has been placed against the bi-metallic strip 47 when it is in the receptacle, the bi-metallic strip will raise its unattached end which carries the hook 46 as indicated in FIG. 8. As it does this, it raises the rod 50. During this operation, the weight of the cigarette 70 against the door in this tilted position maintains a force on the rod 50 also.

Figure 3:
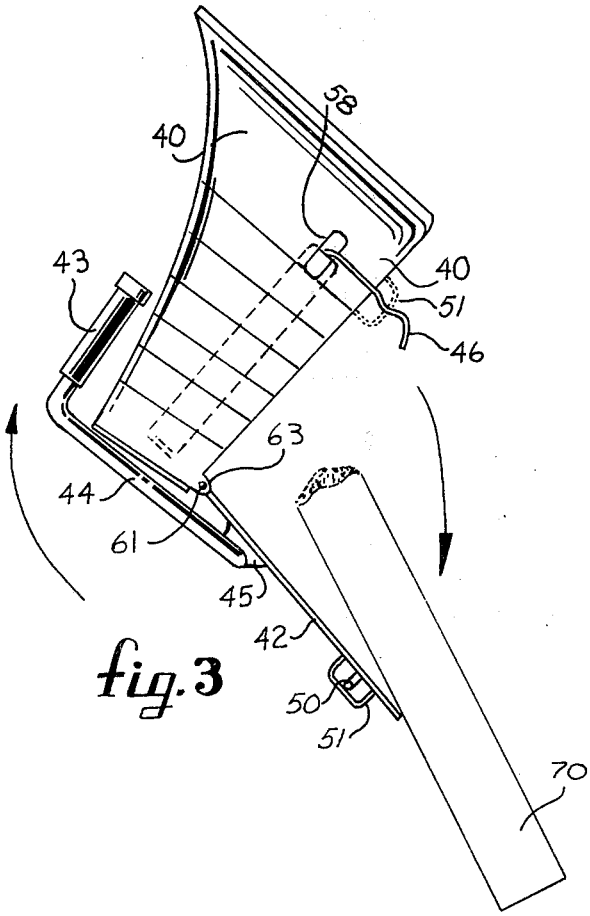
FIG. 3 is a side elevation as FIG. 1, but with the device in operation disposing of a cigarette.

When the cigarette has been extinguished and the heat has dissipated, the bi-metallic strip rapidly returns to the position shown in FIG. 7, bringing the hook 46 downward so that the rod 50 is no longer held on its retainer 51, which causes the hook to drop away from the rod 50 and allows the door to fall open under the weight of the cigarette as is shown in FIG. 3. When the door falls open in this manner, the cigarette then slides or falls from the open door as it is indicated as commencing to do in FIG. 3. When it has lost its contact with the door, the door is urged back into its initial starting position by the effect of the counter-weight 43 and it is then held in position with the rod 50 once again in position upon the hook 46 ready for another cycle of extinguishing and disposing of a cigarette.

An interesting phenomenon will be noted wherein, by the swinging action of the door, centrifugal force will maintain the rod 50 in a position where it is more or less approximating the end of guide 51 nearer the top end of the door 42. In FIG. 3 this position has been illustrated as approximately in the center, although in practical matter it may move a bit, but particularly during the reverse swinging of the door to its closed position, the rod, being of the shape as illustrated, will be thrown centrifugally about its pivot position in such manner that it will touch or be close to the upper portion of the guide 51, thus insuring that it will be in position to drop when the door is in its closed position and become engaged by the hook 46 appropriately. It will then be ready for the application of the upward pressure by the movement of the bi-metallic strip carrying the hook 46.

As particularly mentioned before, it is especially desirable to utilize a magnetic base 57 which can be used to adhere to a surface of an automobile or the like since this device is particularly valuable in that application.

The flared upper portion of the receptacle 40 is particularly valuable when the device is used on the road in a vehicle, since a cigarette smoker who is driving a vehicle may place the same easily into the flared out opening and let it drop down against the bi-metallic element in the confined lower portion where the cigarette is snuffed out. An ultimate disposal container or package (not shown) may be located in the proximity of the device in such manner as to catch the ejected cigarette after it has been snuffed out and ejected from this device. Such an item as a plastic bag or the like may be used with safety with this device, since only when the cigarette has been snuffed out will it leave the receptacle. Such an extinguished, or snuffed out, cigarette, may, of course, be allowed to fall to the floor of the vehicle or to any other place, since it will not cause combustion.

While the embodiment of this invention shown and described is fully capable of achieving the objects and advantages desired, such embodiment has been shown for illustrative purposes only, and not for purposes of limitation.

I claim:

1. The method for extinguishing and disposing of lighted cigarettes comprising the following steps; placing the lighted cigarette in a receptacle; sensing the heat generated by the lighted cigarette; maintaining the said cigarette confined with said receptacle so long as the heat of burning is sensed; sensing the cessation of burning by the sensing of cessation of heat generated thereby; and allowing to drop said cigarette from said receptacle when the cessation of burning has been sensed as above set forth.

2. A device for extinguishing and disposing of burning cigarettes comprising: means to hold a burning cigarette with its burning end in a confined space; movable activation means within said confined space; heat sensing means within said confined space; door means on one side of said holding means; means for dropping a cigarette from said holding means when said door means is open; means to maintain said door means in a closed position when no cigarette is in said cigarette holding means; means to change the location of the means holding said opening closed when a burning cigarette is in contact with said sensing means; means to open said door means activated by said sensing means when burning has ceased; means to drop a formerly burning cigarette from said holding means when said formerly burning cigarette has ceased to burn; means attached to said door means to close the same after a formerly burning cigarette has been removed therefrom; and means to mount said holding means in a substantially upright position.

3. The device of claim 2 in which the said heat sensing means comprises a bi-metallic strip.

4. The device for extinguishing and disposing of burning cigarettes as set forth in claim 2, in which the means for maintaining the door means in a closed position includes a latching mechanism connected to the end of a similarly activated bi-metallic strip against which the cigarette is placed.

5. A device for extinguishing and disposing of burning cigarettes comprising: an elongated receptacle opan at one end and closed at its other end and having one movable door of sufficient size that a cigarette resting against said side door falls from said receptacle upon the opening of said side door; means mounting said side door to said receptacle in such manner that when a cigarette is in said receptacle with the latching means unlatched, that said side door open; means to return said door to a closed position when said side door is open and no cigarette is within said receptacle; said latching means normally holding said side door in a closed position, heat sensing means attached to said latching means so as to move said latching means while under the influence of the heat of a burning cigarette, and in which said heat sensing means unlatches the said door means upon sensing the reduction of heat of said cigarette; and mounting means for said apparatus.

6. The device of claim 5, in which said latching means comprises hook means on the exterior of said chamber carried by a member passing from the exterior to the interior of said chamber, which member is connected to a bi-metallic strip fastened to the interior of said chamber and constituting the heat sensing element.

7. The device of claim 6 in which the said latching means contacts a moveable means upon said opening when said opening is closed which said moveable means is held in one position by centrifugal force when said opening means is moving and moves to another position when said opening means is not moving.

8. Apparatus for extinguishing and disposing of cigarettes comprising: chamber means open on one end and having a door on one side, said chamber means being capable of holding a cigarette in substantially a vertical position, means extending through the wall of said chamber means holding said door normally closed, a bi-metallic strip fastened on the interior of one side of said chamber and extending downward in the proximity of the base of said chamber and upward along the other side, and fastened at its other end to said door holding means in such manner so that upon heat being applied to said bi-metallic strip it will lift the door holding means in an upward direction; means on said door movable with relation thereto and in contact with said door holding means and moveable in accordance with upward movement of said door holding means; friction means associated with said means on said door contacting said door holding means such that when there is pressure applied to said door said means holding said door holding means will remain in an upward position when the said door holding means is removed therefrom, in order to allow said door to open; and means to return said door to closed position when it is in the opened position with no other object holding it in the open position.

9. A cigarette extinguishing receptacle including a container for holding a cigarette which is first burning, and due to the holding causes the extinguishment thereof; an ejectment device suitable to eject the cigarette upon extinguishment; and means to sense extinguishment of the cigarette and activate the ejectment device.

10. A cigarette extinguishing device comprising a receptacle suitable to hold a burning cigarette; a bi-metallic strip within said receptacle so arranged so as to be in contact with the burning portion of said cigarette; means to eject the formerly burning cigarette when the same has been extinguished, which means to eject the extinguished cigarette is activated by movement of the bi-metallic strip due to cessation of the heat of burning of the cigarette.

* * * * *